US005088460A

United States Patent [19]

Echeverría

[11] Patent Number: 5,088,460

[45] Date of Patent: Feb. 18, 1992

[54] ENGINE BRAKE SYSTEM FOR ALL TYPES OF DIESEL AND GASOLINE ENGINES

[76] Inventor: Gregorio J. Echeverría, Arroyo Grande, Municipio Cutzamala de Pinzón, Guerrero, Mexico

[21] Appl. No.: 402,127

[22] Filed: Sep. 1, 1989

[30] Foreign Application Priority Data

Sep. 5, 1988 [MX] Mexico ..... 12929

[51] Int. Cl.[5] ..... F02D 17/02

[52] U.S. Cl. ..... 123/322; 123/321; 123/327

[58] Field of Search ..... 123/321, 322, 327, 90.16, 123/198 F

[56] References Cited

U.S. PATENT DOCUMENTS

| | | | |
|---|---|---|---|
| 1,435,124 | 11/1922 | Mersch | 123/198 F |
| 2,197,282 | 4/1940 | Walker | 123/321 |
| 2,733,696 | 2/1956 | Schneider | 123/327 |
| 3,572,300 | 3/1971 | Stager et al. | 123/321 |
| 3,866,588 | 2/1975 | Nakada et al. | 123/327 X |
| 4,151,824 | 5/1979 | Gilbert | 123/198 F |
| 4,188,933 | 2/1980 | Iizuka | 123/322 X |

*Primary Examiner*—Tony M. Argenbright
*Attorney, Agent, or Firm*—Ladas & Parry

[57] ABSTRACT

An engine brake system for use in all types of diesel and gasoline engines, comprising a control means disposed, in the main embodiment of the invention, on the top of the line of valve rocker arms, seated on the supports of the rocker arms, and a dislodgement valve installed in the intake manifold of the engine, the valve remaining closed until the brake system is applied. An actuating device acts when the brake is applied, longitudinally displacing the control means, whereby the rocker arms of the exhaust valves are uncoupled from the corresponding tappet rods thereby impeding the exhaust valves to open, whereby the gases trapped in the cylinders put up resistance to the ascending movement of the pistons in their exhaust stroke. The discharge of the gases toward the environment, via the dislodgement valve, occurs when the opening of the intake valves begins at the start of the intake stroke of the pistons.

46 Claims, 12 Drawing Sheets

ENGINE BRAKE SYSTEM FOR ALL TYPES OF DIESEL AND GASOLINE ENGINES

BACKGROUND AND OBJECTS OF THE INVENTION

In the automotive market the application of engine brake systems is markedly limited to those engines such as Cummings and General Motors which include a third rocker arm in middle of the intake and exhaust rocker arms from where the activation mechanism is taken to dislodge the gases and thus brake the engine.

The obvious limitation of the conventional engine brake system, added to the high cost of said system and the need for specialized maintenance, made it necessary to search for feasible alternatives for this type of system and particualrly alternatives that could be applied generally to diesel or gasoline engines, whether large or small.

In accordance with the foregoing, the main object of this invention is to provide a new engine brake system regardless of size of engine and type of fuel used for operation.

Another object of the invention is to provide a novel brake system whose design is simple and functional, as well as safe, and that does not require specialized maintenance and therefore having a low cost.

A further object of the invented system is the opportunity to select various alternatives for realization, each one reliable and proven to be functional.

In order to facilitate understanding of the object of the invention stated above and the corresponding novelty of the brake system, a detailed description of the system is enclosed with this application, complemented by the necessary drawings, which adequately illustrate the different parts making up the brake system. Each of the figures is described below:

Figure 7:
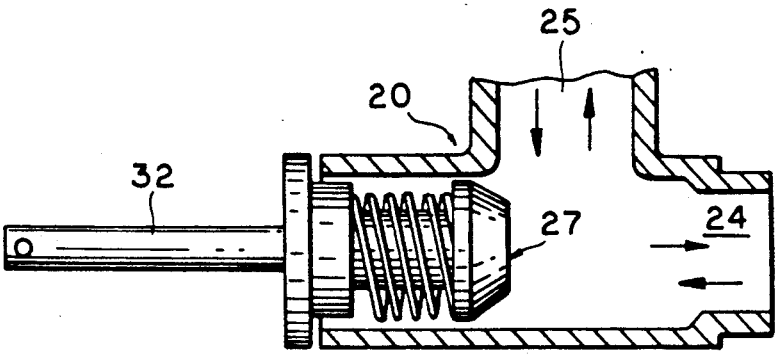
Figure 8:
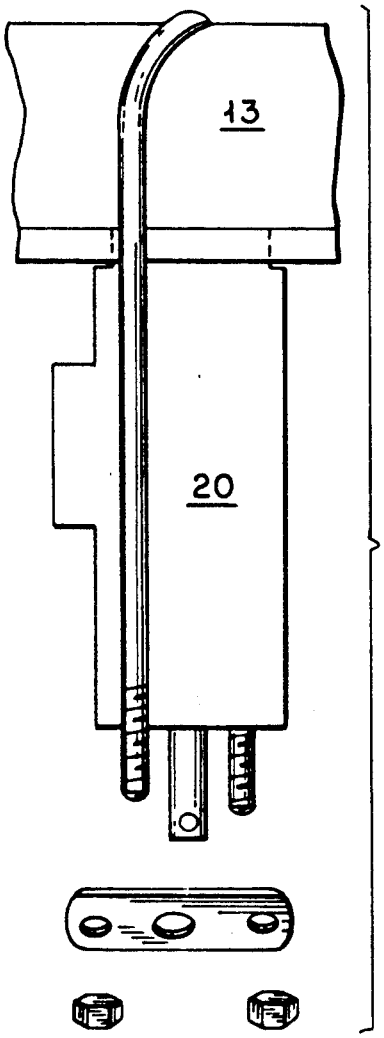
Figure 9:
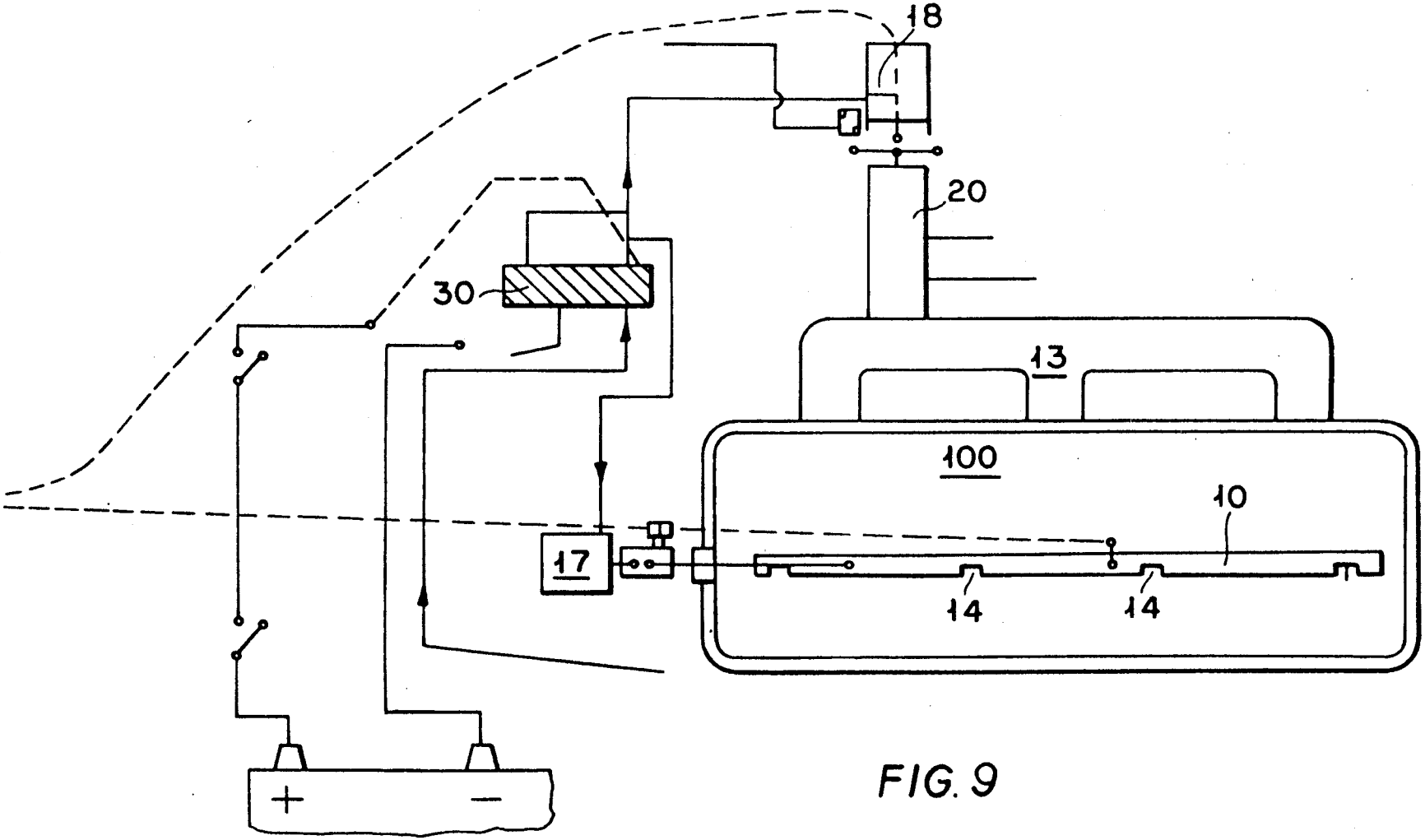
Figure 10:
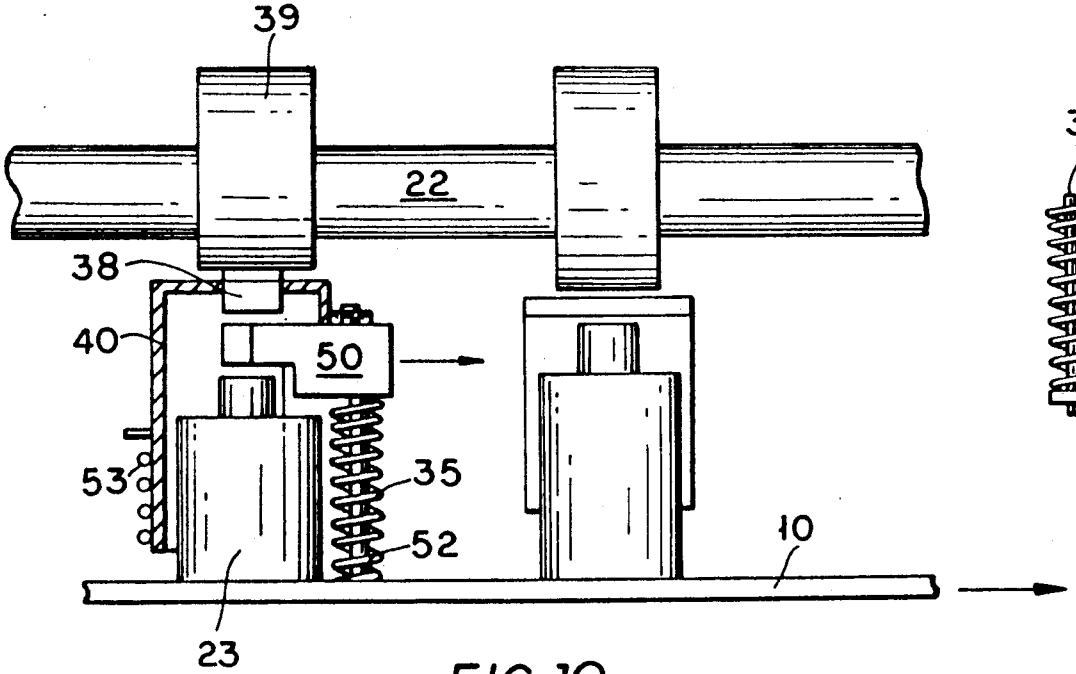

FIG. 7 also shows the dislodgement valve in open position;

FIG. 8 shows an embodiment for fastening or anchoring the dislodgement valve in the intake manifold;

FIG. 9 is a diagrammatic representation of the engine brake system;

FIG. 10 is a partial view of a third embodiment of the brake system incorporated into overhead camshat engines.

Figure 11:
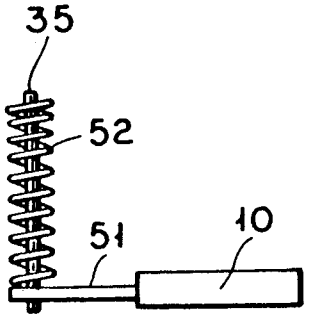
Figure 12:
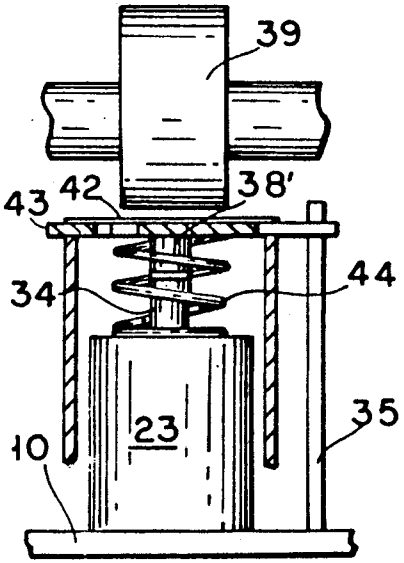
Figure 13:
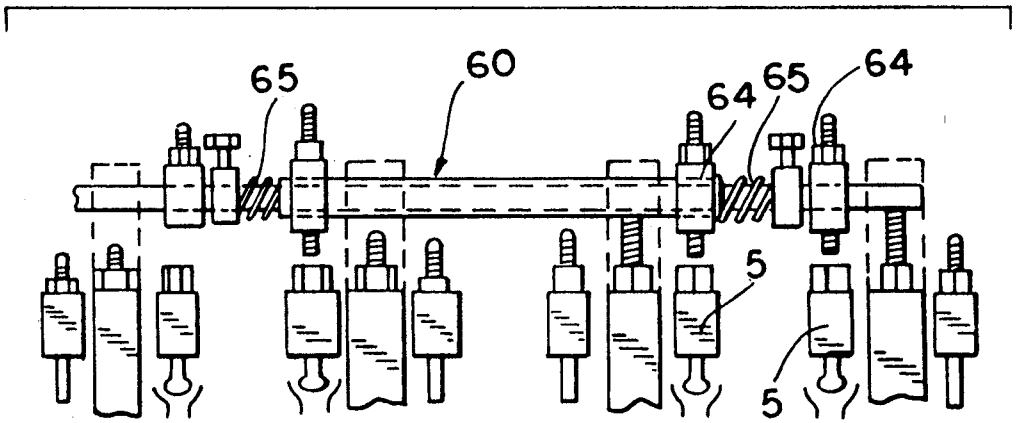
Figure 14:
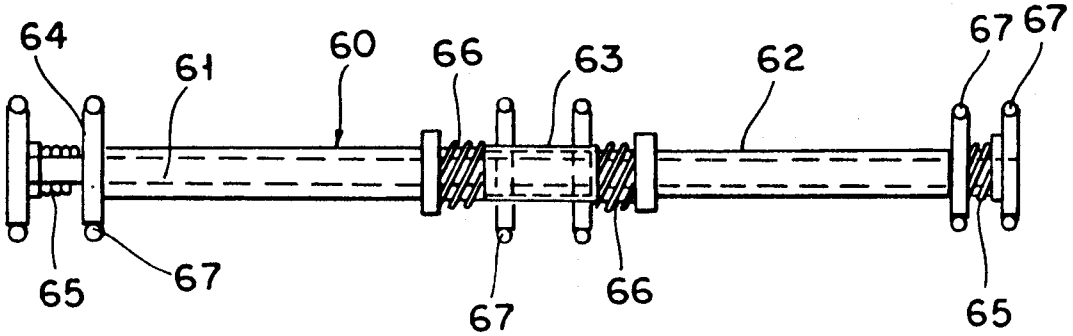
Figure 15:
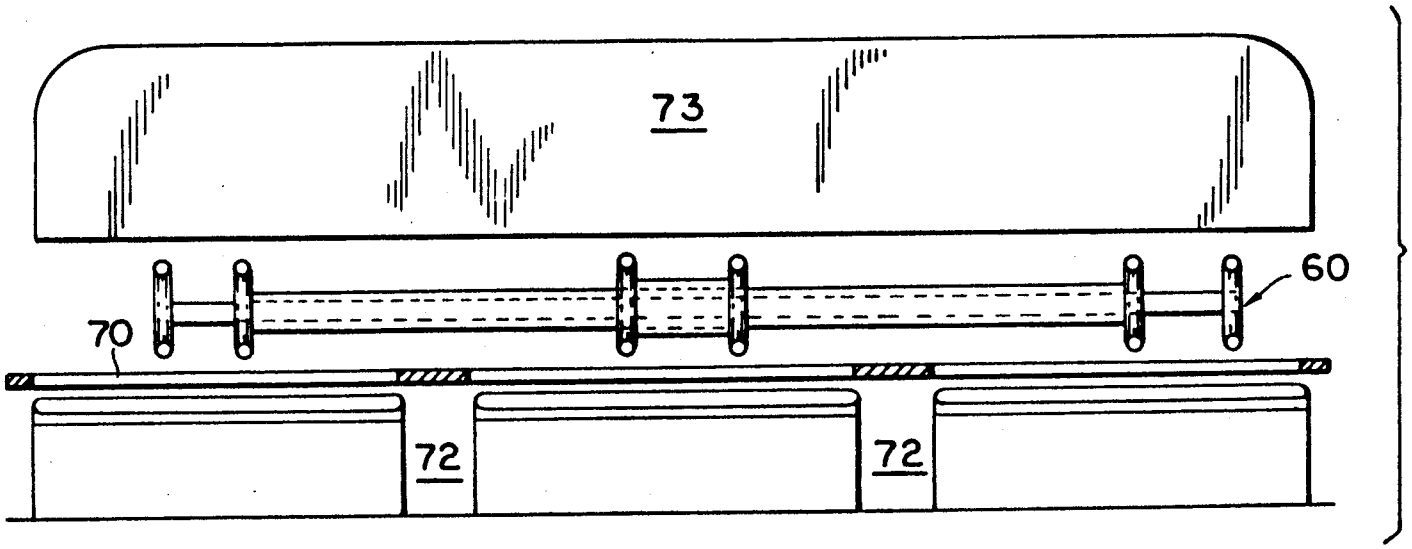
Figure 16:
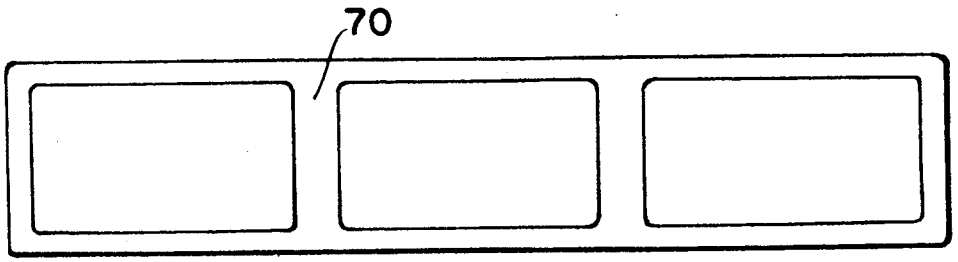

FIG. 11 is a partial lateral view of the assembly illustrated in FIG. 10 in order to visualize the portion of the control means that connects the latter with a pin supporting a wedge (not shown) provided for this third embodiment;

FIG. 12 is a lateral view of a sectioned plunger which illustrates a technical embodiment in substitution of the wedge mechanism shown in FIG. 10;

FIG. 13 is a partial lateral view of a four-cylinder engine provided with a joining mechanism for interconnecting the rocker arms of the intake valves in order to increase the breaking capacity of the claimed system;

FIG. 14 is an upper view of the joining mechanism of FIG. 13, adapted to a six-cylinder engine;

FIG. 15 represents an exploded engine having independent heads which includes the joining mechanism;

FIG. 16 shows a special design of a metallic joint for the motive assembly of FIG. 15.

Figure 17:
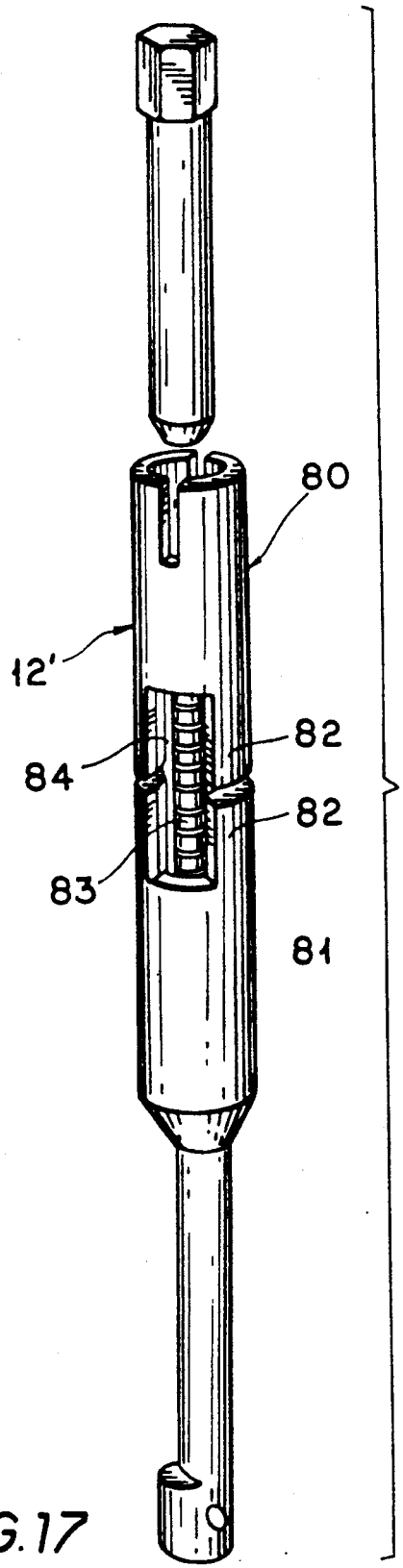
Figure 19:
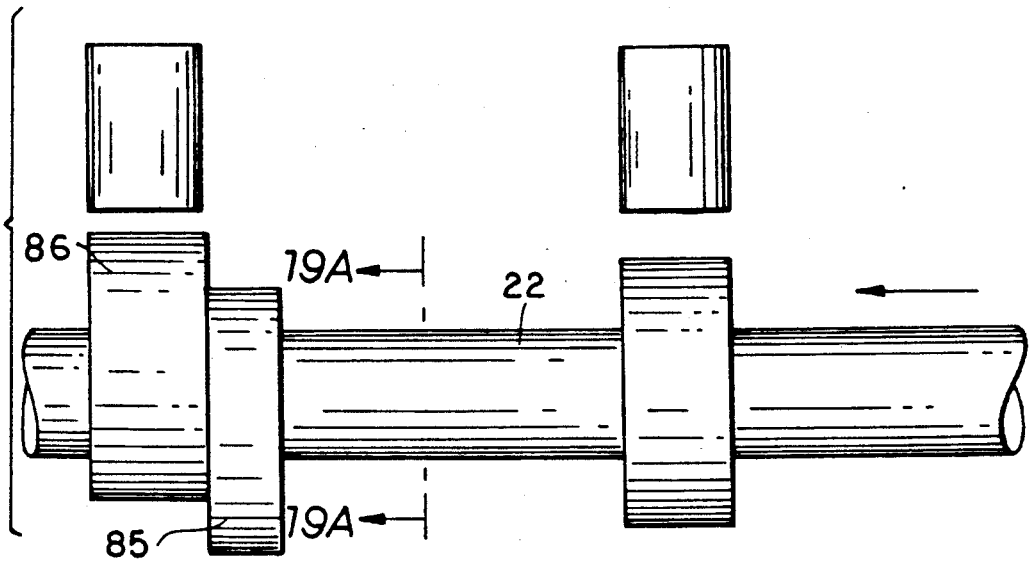
Figure 19A:
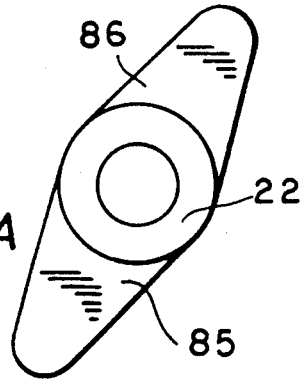
Figure 18:
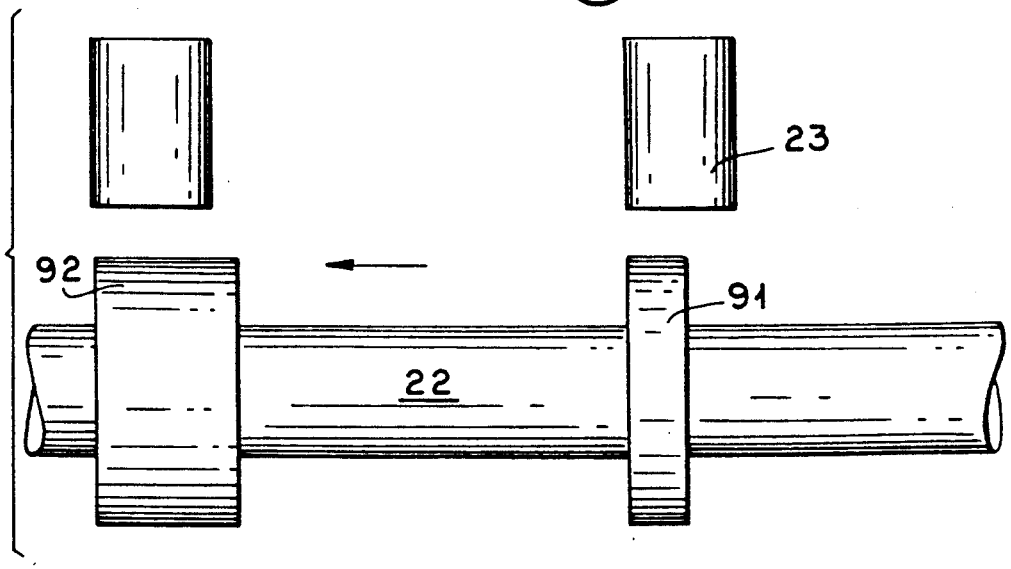
Figure 20:
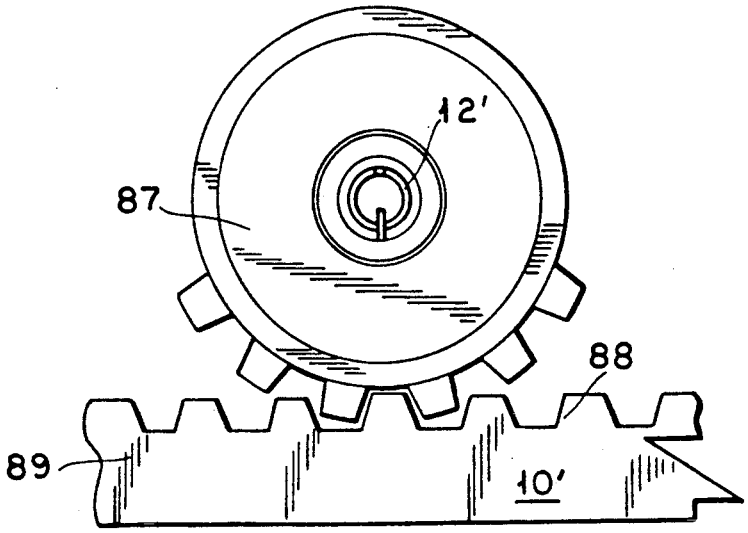
Figure 20A:
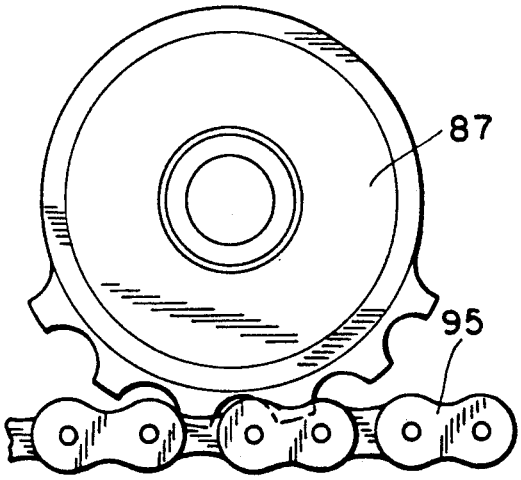
Figure 20B:
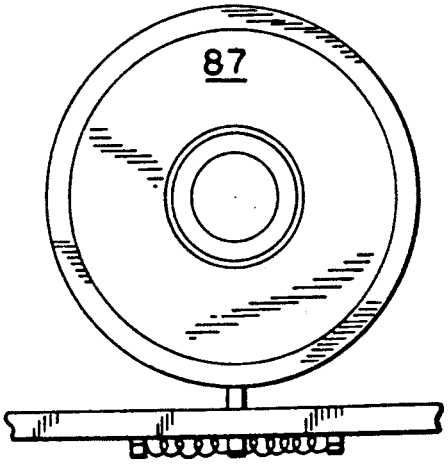

FIG. 17 represents a new design of valve tappet rod shown in exploded condition;

FIG. 18 depicts a new arrangement to actuate the engine brake system by displacing the camshaft;

FIG. 19 illustrates an arrangement specially designed for increasing twofold the braking capacity of the claimed system;

FIG. 19A is a side view of the camshaft taken along plane A—A' of the arrangement represented in FIG. 19;

FIG. 20 shows a special soleplate-gear combination used alternatively by the invented system for applying the same; and FIGS. 20A and 20B represent two additional embodiments for preventing the transmission of motion from the camshaft to the exhaust valves by disconnecting the tappet rods.

DETAILED DESCRIPTION OF THE INVENTION

The brake system comprises a control means 10, comprising an elongate plate member, placed on the upper part of the set of rocker arms 11 in a first embodiment and, in a second embodiment, on the middle part of the exhaust valve tappet rods 12; and a dislodgement valve 20 (FIGS. 6 and 7) installed in the intake manifold 13 of the engine 100, which valve remains closed until the brake system is applied by means of an actuating device 30 (electrovalve) which simultaneously activates the actuating device 18 of the valve 20 and the element 17 which activates the plate member 10.

The control means 10 is seated on the supports of the rocker arms and presents various recesses 14 which, each one defines a housing where the projecting bolt of each exhaust rocker arm 5 is received. The rocker arms 5 and the tappet rods 12 are in contact through the adjustment screw 6 in the lower end of the rocker arm 5 and the upper end portion 15 of said rod 12, when the brake system is not applied. The end portion 15 of the rods 12 has a lesser diameter in comparison with the remaining portion thereof.

When the brake system is applied, the activating device 30, comprising a piston activated by oil pressure, by air pressure or by vacuum, longitudinally displaces the plate member 10 which, in turn, displaces the rocker arms 5, thereby breaking the contact among the rocker arms 5 and the corresponding tappet rods 12, and consequently the movement of the camshaft 22 is not transmitted to the exhaust valves 23 of the engine.

Figure 3:
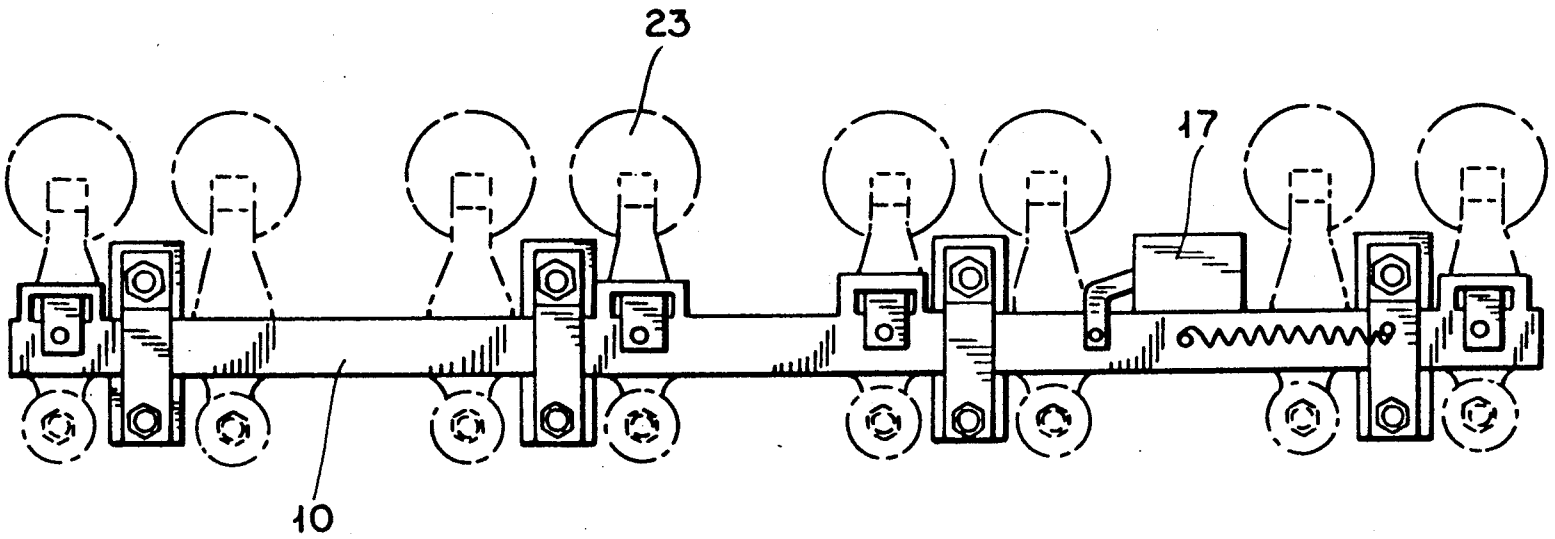
FIG. 3 is an upper view of the mechanism for displacement of the rocker arms for engines equipped with a rocker arm bar.

In the embodiment of the system wherein the control member 10 is disposed on the line of the rocker arms, two alternatives are obtained. The first one is represented in FIG. 3, where the plate member 10 is placed in the center of the rocker arms, and which is applicable for engines having rocker arm bar; the displacement of the rocker arms in this first alternative is completely longitudinal with respect to the bar 11 or to the plate member. The second feasible alternative corresponds to that of FIG. 4, where said plate member 10 is arranged directly over the adjustment screws 6 which upwardly protrude in a sufficient lenght to secure permanently the connection between the plate member 10 and the rocker arms. This arrangement of the plate member is applied for those engines which have no rocker arm bar and the movement generated in the rocker arms is essentially rotary with respect to the center of the rocker arms.

Figures 2A, 2B:
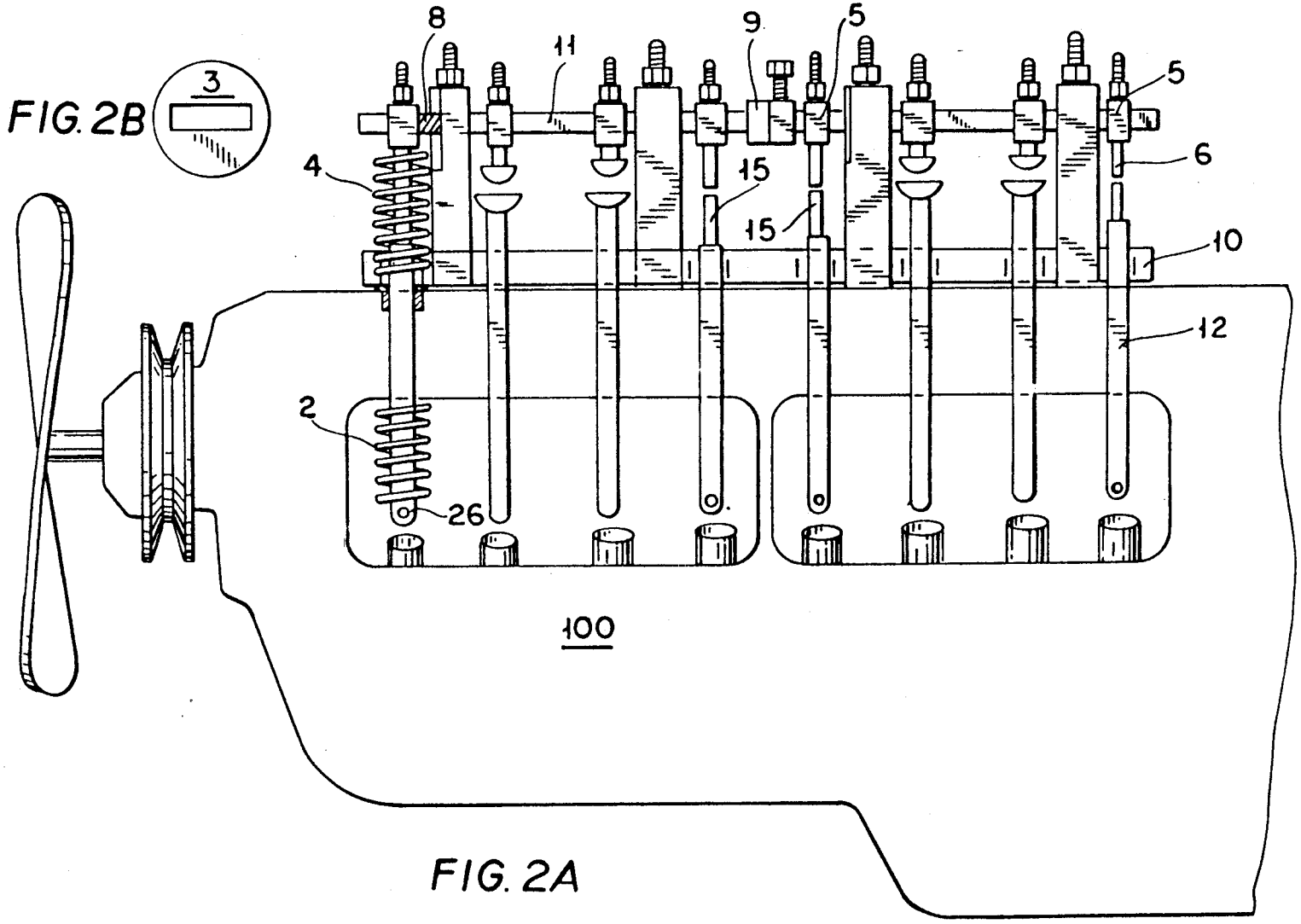
FIGS. 2A and 2B are also a lateral view of the sectioned engine, but with the adaptation of the control means over the cylinder head of the engine, on one side of the tappet rods.

In a second embodiment of the system, the plate member 10 is placed just over the cylinder head of the engine (see FIG. 2), on one side of the tappet rods 12, to which it lodges between two bolts 6 in order to displace them, disconnecting them from the rocker arms 5 when the brake is applied and to connect said tappet rods again to said rocker arms when said brake is deactivated. It will be noted that in this embodiment the rocker arms 5 and the rods 12 are disconnected by the displacement of the rods.

Figure 1:
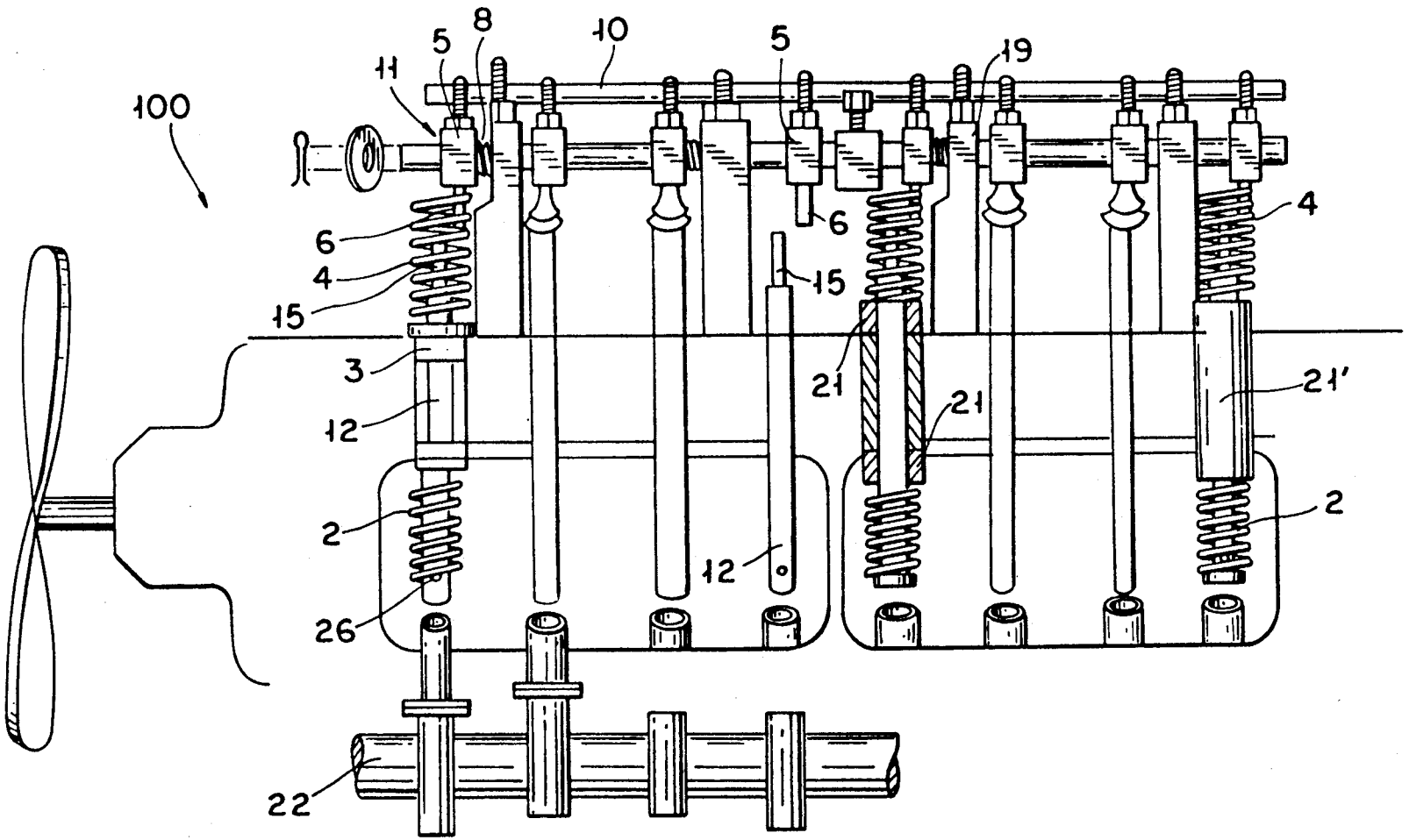
FIG. 1 is a view of a vertically sectioned engine with the dephased exhaust valve rocker arms, and the control means on the top of line of the rocker arms, and wherein further two types of devices for centering the exhaust valve tappet rods are also illustrated.

As can be observed in FIG. 1 a centering device 3 is provided on the upper part of the cylinder head in order to keep each rod 12 centered. Spring means 4 are supported on the centering devices 3, for maintaining the separation between the rocker arms 5 and the rods 12, by pushing the rocker arms upward. An additional spring means 2, one end thereof being supported on the lower part of the cylinder head and the opposite end contacting on a bolt 26 projecting transversely from each rod, carries out substantially the same function as the spring means 4, that is, to maintain the separation between said rod 12 and the rocker arm 5, but in this case by pushing the rod downward.

In FIG. 1, another embodiment for centering the rod 12 is appreciated, consisting in a pair of centering pistons 21, each one secured to the rod 12 at the height of the upper and lower limits of the perforation in the cylinder head for the rod, but without leaving such perforation when displaced rectilineally. Alternatively, a tubular member 21' having the diameter of the perforation of the cylinder head for rods can be used appropriately. It would be necessary only to secure rod portions to the ends of the member 21'.

An additional characteristic of the system is the opportunity to selectively vary the displacement range of the rocker arms 5 by reducing the width either of the rocker arms or of the supports 19. In some cases, a stop element 9 is disposed in the rocker arm bar 11, to limit displacement of the rocker arms which, because of their position, lack a support that serves as a movement limiting stop.

The alignment and contact relationship existing between the rocker arms 5 and the rods 12, when the engine is operating without application of the brake system, is appropriately maintained by means of spring elements 8 placed in the rocker arm bar 11.

Figure 6:
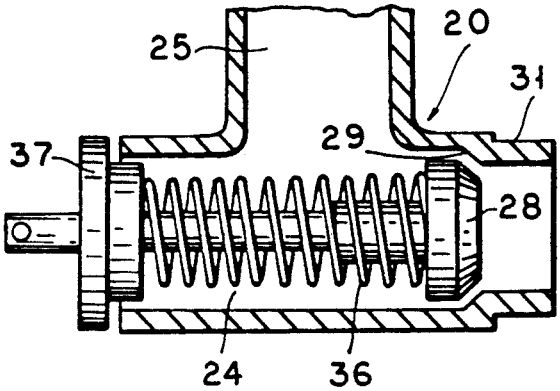
FIG. 6 represents the dislodgement valve in closed position.

The dislodgement valve 20, which in FIGS. 6 and 7 is illustrated closed and open, respectively, is disposed exactly on a location of the manifold 13 where it does not interfere with the common accesories of the engine 100. The type of valve 20, particularly described in FIGS. 6 and 7, consists in a T-shaped member formed by a first and second passages (24, 25) and an obturating element 27 reciprocably movable along the first passage 24.

When the valve 20 is closed (FIG. 6), the obturator head 28 of the element 27 is abutting against a seat surface 29 formed in the passage 24 by the narrowing 31 thereof. A cap member 37 having a central through hole is fixed firmly to the opposite end of passage 24 to seals the latter, said cap serving as a support for the spring element 36 which surrounds the stem 32 of the obturating element 27. The stem 32 passes through the cap 37 via the through hole therein and may be shaped like a stepped bar including two different diameters, the largest of them being adjacent the head 28 and further serving as a stop to limit the longitudinal displacement of the obturating element 27 when the valve opens.

In an alternative embodiment, stem 32 can be a bar with a uniform diameter provided with a bushing which performs the function of a stop when the element 27 is directed toward the position shown in FIG. 7. In addition, it should be understood that even when the head 28 of the obturating element 27 is shown in a truncated cone form it can be modified conveniently into a different shape, for example, flat, conical or semispherical, adapting corresponding the form of the seat surface 29.

It is important to point out that the opening and closure of the dislodgement valve 20 is directly related to the operation of the brake system, that is, when the system is activated, the valve will open simultaneously, remaining so until the system has been deactivated.

A skilled person will readily deduce that the dislodgement valve 20 described hereinbefore may be substituted properly by an air inlet disc valve.

FIG. 10 represents a third embodiment of the brake system applied to engines equipped with the overhead camshaft. In accordance with the illustration, the camshaft 22, during its rotary movement, pushes downwards by its cam elements 39 the upper part of the plungers 40 which each includes within same a projection 38 to transmit the descending movement to the exhaust valves 23, through an intermediate wedge mechanism 50.

The transmission of movement described in the preceding paragraph corresponds to the normal functioning of the engine with the overhead camshaft.

Now then, when the brake system is applied, the member 10 is moved toward the right, as indicated by arrows in FIG. 10, thereby moving the wedge 50 in the same direction since the upright positioning bolt 35 of the wedge is connected to the arm portion 51 of the plate member 10. Thus, the lateral displacement of the wedge 50 interrupts the transmission of the movement of the camshaft 22 to the valves 23.

In accordance with this embodiment, the wedge 50 goes into the plunger 40 through a vertical groove practiced in the plunger. It is, however, important to point out that normal functioning of the engine or with the new brake system applied. To secure the automatic upwards return of the plunger 40, a spring means 52 is arranged surrounding the bolt 35 of the wedge. In addition, a spring means 53 is provided outside the plunger 40 in order to keep it in contact with the corresponding cam element.

In a further version of this embodiment, the wedge 50 can be substituted by a foil element 43, which crosses the upper part of the plunger 40 and being provided with a bolt 38' and an adjacent perforation 42, wherein the stem 34 of the valve 23 is received once the foil 43 has been displaced toward one side upon applying the brake system. As shown in FIG. 12, the foil 43 is connected to the control plate member 10 by means of the guide bolt 35 which crosses a through hole provided on one end of the foil 43. To prevent noise to be generated by the foil, a spring means 44 is incorporated inside the plunger in the manner shown in FIG. 12. Alternatively, the disconnection of each exhaust valve can be achieved by displacing the rocker arms to be dephased from the stem of the valve. In this embodiment, the tappet rods are conventional and a spring will be arranged between the valves and the rocker arms.

Although the invention has been described heretofore in accordance with the preferred embodiment thereof, an expert in this matter will appreciate that this system can offer variations according to the circumstances of each case, for example, the upper end of the plunger can have a flat surface for those new automotive models or a shoe on the lower end of the rods for the units with a conventional engine (FIG. 1). Furthermore, it has been found that the application of the brake system will become softest if the control plate means is sectioned in two parts joined by a resilient element.

Figure 4:
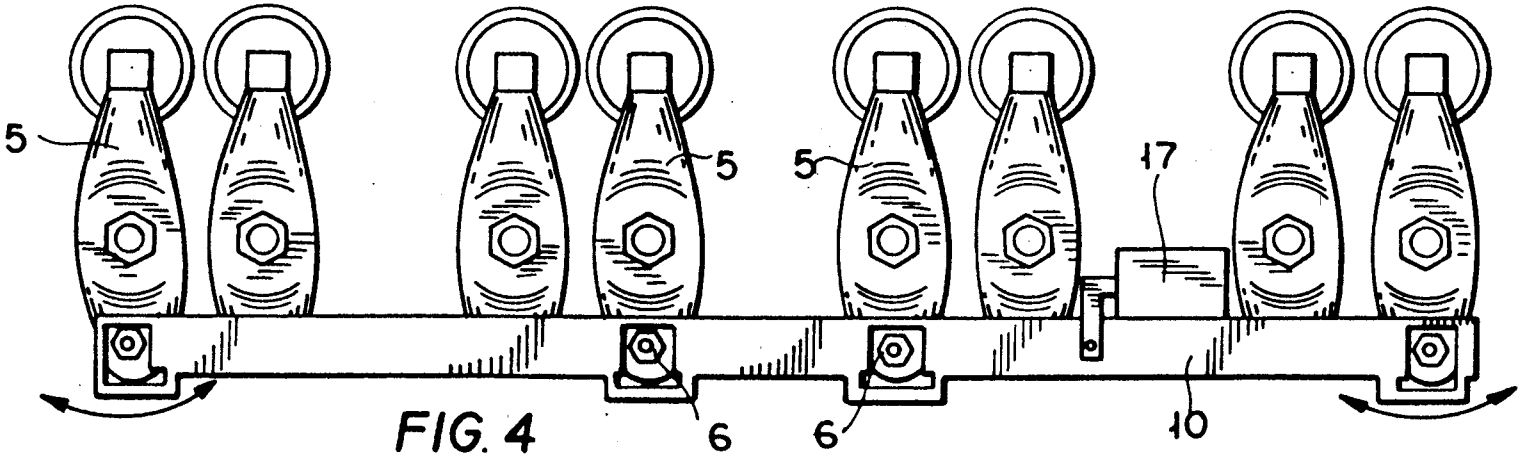
FIG. 4 is also an upper view of the mechanism for displacement of the rocker arms, but with the control means located directly over the adjustment screws for those engines which have no rocker arm bar.
Figure 5:
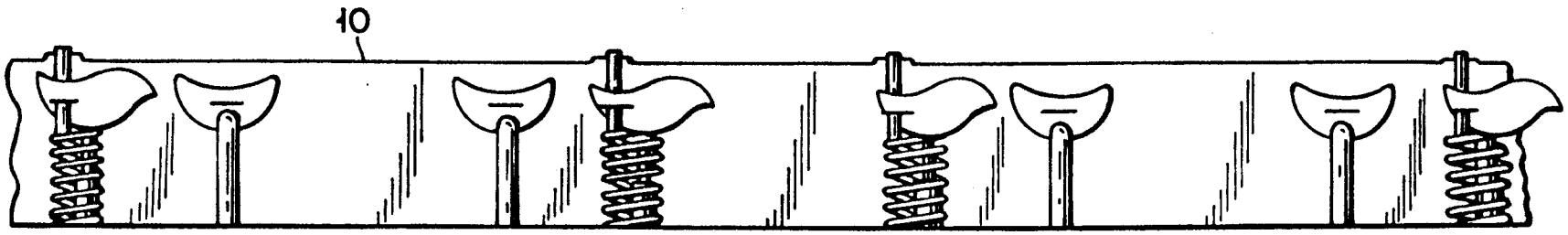
FIG. 5 is a lateral view of the displacement mechanism of the rocker arms shown in FIG. 4.

Another feature of the system to be considered within the scope of the protection applied for is the location of the activator device 17 of the plate member 10 inside or outside the engine valve cover, as indicated, respectively, in FIGS. 4 and 9. Another alternative applicable to the system is fastening of the dislodgement valve to the intake manifold by different means from those indicated by way of example in FIG. 8, such as the screws extending exteriorly along the passage 25 to screw down the manifold.

As an additional embodiment of the invention, a special mechanism 60 can be incorporated into the brake system for operatively joining the rocker arms of selected intake valves, whereby the percentage of braking of the invented system is increased. The joining mechanism 60 installed in a six-cylinder engine (FIG. 14) would comprise a set of interconnection elements comprising a bar element 61 which joins the rocker arms 5 of the intake valves of pistons 1 and 6, a first tubular member 62 interconnecting operatively the rocker arms corresponding to the intake valves of pistons 2 and 5; the bar element 61 extending interiorly along the entire lenght of the tubular member 62; and a second tubular member 63, having a greater diameter than the first tubular member 62, which interconnects the rocker arms of the intake valves of pistons 3 and 4 to operate jointly. The connection between the joining mechanism 60 and the intake valves of the corresponding engine is established via additional rocker arms 64 provided with adjustment screws on both ends 67. The rocker arms 64 are arranged to the mechanism 60 to get in contact with the rocker arms 5 of the engine. The mechanism 60 is further mounted on conventional supports in a manner similar as that used for the conventional rocker arm mechanism.

As observed in FIG. 13, when the joining mechanism is arranged on a four-cylinder engine, bar 61 and only one tubular member 62 are required to interconnect respectively the rocker arms of the intake valves of pistons 1-4 and 2-3.

The operation of the joining mechanism 60 incorporated to the brake system is as follows: when the brake system is not applied, the rocker arms 64 of the joining mechanism are dephased with regard to rocker arms 5 of the engine, however, when the brake is applied, the rocker arms 64 of the mechanism are disposed in alignment with the intake valve rocker arms of the engine in order to move jointly, by means of the assembly of bar and, the intake valve rocker arms of the pistons which are usually related to each other 1-6, 2-5 and 3-4, in six-in-line engines. Thus, when a piston brakes, taking advantage of the gases trapped in the cylinder, the braking of the system is increased since the movement of the rocker arm of this piston, to open the valve, is transmitted via the joining mechanism 60 to the intake rocker arm of the piston being synchronized with the firstly-mentioned one.

The joining mechanism 60 illustrated in FIG. 13 is provided with two spring means 65 which exert pressure on both ends of the tubular member. These spring means allow the joining mechanism to apply by pairs the corresponding rocker arms since they cannot be applied simultaneously. In the case of a six-cylinder engine, the joining mechanism 60 functions in the way described before, but with the necessary incorporation of two additional springs 66 for exerting pressure on the ends of the second tubular member 63, as indicated in FIG. 14.

In order to extend the application of the brake system with the joining mechanism to in-line engines with independent heads, a metallic joint 70 has been designed, which extends along the three heads (FIG. 15), covering the recesses 72 between heads of the engine of this type in order to allow adaptation of the joining mechanism 60 along the three independent heads. In this case, an ordinary intake and exhaust valve cover 73 should be used as the ordinary ones for all the assembly.

In addition, the use of a new single-direction air flow valve has been considered for diesel engines that allows the intake of air toward the engine but prevents air circulation in the inverse direction, that is, from the intake manifold toward the air filter when the brake system is applied. In this way, the filter is not dirtied by the returning gases. In turn, the control plate member may include a conventional stop against which it is maintained by a spring when the engine functions normally, that is, with the brake not applied.

FIG. 17 illustrates a specially designed tappet rod 12' that provides another alternative for neutralizing the transmission of movement of the camshaft to the exhaust valves when the brake system is applied. As observed in said FIG. 17, the rod 12' comprises an upper rod portion 80 and a lower rod portion 81 arranged in alignment and in permanent contact by one of their ends during normal functioning of the engine, that is, when the brake system is not applied. Each contact end of the portions (80, 81) is provided with opposed protuberances 82 defining notches 84 therebetween. Additionally, a spring means 83 extending axially between the portions (80, 81) is disposed to push each rod portion (80, 81) in opposite directions, thereby maintaining the necessary contact relationship between both rod portions.

In order to comply with the purpose of preventing the transmission of the movement of the camshaft to the exhaust valves, one of the two rod portions (80, 81) is fixed by an appropriate means so that said fixed portion has no rotary movement over its own axis, while the other portion, to which the control plate member 10' is connected, can be slightly turned when the plate member 10' is displaced longitudinally upon applying the brake system. Due to the protuberances 82 of the contact ends of the rod portions (80, 81) when one of the said portions is turned approximately 90°, the alternative movement of the rod portion which is in contact with the camshaft cannot be transmitted to the exhaust valves, whereby the latter valves will remain closed while the brake system is being applied.

In addition to the options described above to activate the engine brake system, FIG. 18 depicts one more embodiment which consists in activating said system by means of the longitudinal displacement of the camshaft in such a way that the exhaust valve actuating cams are thereby disaligned from the corresponding exhaust valve tappet rods. Thus, the rotary motion of the camshaft is not transmitted temporarily to the exhaust valves which remain closed while the brake system is applied.

In one embodiment, the preceding alternative for activating the brake system is represented in FIG. 18, wherein the width of the exhaust cams 91 is smaller than that having the intake cams 92. In this arrangement, a predeterminated longitudinal displacement of the camshaft will cause the exhaust cams 91 to be dephased from the plungers of the exhaust valves, thereby impeding said exhaust valves to open, trapping the gases inside the cylinders of the engine. As a result of the greater width in the intake cams 92, these will continue transmitting the motion from the camshaft to the corresponding intake valves.

In a second embodiment, dephasing the exhaust cams from their respective plungers, by the minimum displacement of camshaft, can be achieved if the conventional exhaust cams are disposed nearer or farther to the intake cams. This additional possibility may be put into the practice depending on the type of engine.

Another advantage offering the invented brake system consists in duplicating its braking capacity. Therefor, an additional cam element 85 is arranged beside each conventional intake cam 86 in such a manner that both adjacent cam elements maintain a difference of about 180° to each other as shown in FIGS. 19 and 19A. Thus, when the camshaft is moved slightly the intake valves can be actuated each 180° of the rotation of the camshaft or each descending stroke of the piston. In this case, the disconnection of the exhaust cams from the respective rocker arms can be effected by means of any of the alternatives described hereinbefore.

In order to maintain the necessary interrelation between the camshaft gear and the oil pump gear when the camshaft is axially displaced for activating the brake system, the gear of the oil pump can be widened appropriately to prevent its disconnection from the camshaft gear. This principle is also applicable to the camshaft gear that actuates the fuel pump, and the camshaft gear receiving the motion from crankshaft. The latter camshaft gear will be grooved at its center to engage a corresponding grooved surface in the camshaft when a chain connection is used.

To carry out the rotary movement of one of the rod portions (80, 81) when activating the brake system, various embodiments have been illustrated, only by way of example, in FIGS. 20, 20A and 20B. As noted, the control plate member 10' can be provided with teeth 88 like a rack-shaped member 89 for engagement with the gear element 87 including a central perforation through which the tappet rod 12' is displaced reciprocably. Alternatively, the rack-shaped member 89 can be substituted appropriately by a chain element 95 for engaging the gear element 87 (see FIG. 20A). Furthermore, the connection between the control plate member 10' and the element surrounding the tappet rod can be of the type depicted in FIG. 20B, which consists in a bolt protruding from element 87, for insertion loosely in a slot provided in the plate member 10'.

The tappet rod 12' and the element 87 are, in turn, connected to each other by a bolt extending radially inwardly from the central perforation of the element 87 for insertion in one of the grooves formed by protuberances in the upper portion 80 of the tappet rod 12'. This particular connection is exemplified in FIG. 20.

Notwithstanding the mechanical nature of the above-described mechanism for joining the intake rocker arms, it should be understood that the aim of said mechanism 60 can also be reached by other means, for instance, a hydraulic arrangement comprising a pair of hydraulic piston members for each rocker arm, one piston member being aligned with the tappet rod and the other piston member being aligned with the intake valve. The hydraulic piston members of the rocker arms to be operatively joined are connected alternately by means of pipe lines, that is, the piston member in alignment with the tappet rod of rocker arm A is connected to the piston member being aligned with the intake valve of rocker arm B, while the piston member disposed on the intake valve of rocker arm A is connected to the piston member located on the tappet rod of the rocker arm B. The same principle is applicable for joining operatively the remaining intake rocker arms in in-line engines or V-six engines. As distinguished from the joining mechanism 60, the hydraulic joining arrangement is of broadest application.

For adaptation of the brake system in conventional gasoline engines, it is possible to provide two microswitches in the electrical circuit of the brake system, the first microswitch being adapted to operate when depressing the accelerator pedal, whereby said first microswitch will energize a solenoid disposed in the carburetor of the engine for maintaining the normal fuel supply into the engine and for de-energizing said solenoid when releasing the accelerator pedal, thereby interrupting the fuel supply into the engine. In turn, the second microswitch will be arranged to apply the brake system when the accelerator pedal of the vehicle is not depressed and to deactivate the brake system in depressing again the accelerator pedal.

What is claimed is:

1. An engine brake system for all types of diesel and gasoline engines, comprising a control means arranged on the upper part of the line of rocker arms, resting over the supports of the rocker arms, and a dislodgement valve installed in the intake manifold of the engine, which remains closed until the brake system is applied, and which is open when the engine brake is applied by a valve activating device; a second activating device longitudinally displaces the control means when the brake system is applied, uncoupling the exhaust valve rocker arms from the corresponding tappet rods, thereby preventing the exhaust valves from opening, maintaining the gases trapped in the cylinders so as to oppose resistance against the ascending movement of the pistons in their exhaust stroke.

2. The engine brake system described in claim 1, wherein the control means has a plurality of recesses, each embracing a bolt projecting upwardly from each exhaust rocker arm.

3. The engine brake system described in claim 1, wherein the contact between each rocker arm and its respective tappet rod is carried out by means of an adjustment screw having a flat lower end, and the upper end of the rod, which presents a lesser diameter than that of the remainder of the rod.

4. The engine brake system described in claim 1, wherein a plurality of centering devices are placed on the upper part of the cylinder head of the engine to maintain each tappet rod in its centered position.

5. The engine brake system described in claim 1, including a first spring means seated on each centering device whose upward pressure maintains the separation between the rocker arm and the valve tappet rod; and a second spring means supported on the lower part of the engine monoblock, whose downward pressure exerted against a traverse pin of the rod maintains the separation between said rod and the corresponding rocker arm.

6. The engine brake system described in claim 1, wherein the width of at least one of the rocker arm and the support is selectively reduced in order to increase the lateral displacement range of the rocker arms when the brake is applied.

7. The engine brake system described in claim 1, wherein a stop element is provided on the rocker arm bar to limit the movement of the rocker arms that do not have a support serving as a stop.

8. The engine brake system described in claim 1, including a plurality of spring means placed on the rocker arm bar, each spring means being adapted to abut by one end against the supports of the bar or the stop and exerting pressure by the other end against the rocker arms in order to keep them aligned with the valve tappet rods when the brake is not applied.

9. The engine brake system described in claim 1, wherein the dislodgement valve is placed on any site of the manifold that does not interfere with other accessories of the engine, the exit of the valve being oriented toward the device that channels the gases to the exterior.

10. The engine brake system described in claim 9, wherein the dislodgement valve comprises a first passage along which an obturating element slides reciprocably; said obturating element comprises a stem and an obturator head that, when the valve is closed, seals a seat surface arranged on the end of the first passage, where the stroke of the obturating element ends, in order to establish a hermetic obturation.

11. The engine brake system described in claim 10, wherein the stem of the obturating element comprises a stepped rod surrounded by a spring means arranged to keep the element in the closed valve position, an end of the spring means abutting on the posterior part of the obturator head and its other end abutting against a cap secured on the end of the passage opposite to the seat surface; said cap has a central through hole through which the lesser diameter portion of the stem slides, the greater diameter portion serving as a stop to delimit the rearwardly displacement of said stem during its valve opening path.

12. The engine brake system described in claim 9, wherein the dislodgement valve further comprises a second passage perpendicular to the first passage thereof; said second passage is connected to the element directing the exhaust gases to the exterior and admitting air toward the cylinders.

13. The engine brake system described in claim 10, wherein the head of the obturating element is flat, conical or semispherical, a seat surface being shaped correspondingly in the first passage to achieve hermetic obturation of the valve when it is closed.

14. The engine brake system described in claim 10, wherein the stem of the obturating element is of uniform diameter and further includes a bushing element to limit its rearward displacement along the first passage of the dislodgement valve.

15. The engine brake system described in claim 10, wherein the portion of the dislodgement valve being connected to the intake manifold has a lesser exterior diameter than the exterior diameter the first passage of said valve.

16. The engine brake system described in claim 4, wherein the centering devices of the valve tappet rods comprises piston members placed on the upper and lower ends of the cylinder head; said piston members are displaced alternatively in the orifice that lodges the rods in said head.

17. The engine brake system described in claim 16, wherein the centering device comprises a tubular member containing partially the corresponding tappet rod.

18. The engine brake system described in claim 1, wherein the control means rests directly over the adjustment screws of the rocker arms in those engines lacking a rocker arm bar.

19. The engine brake system described in claim 1, wherein the activating device which displaces the control means upon applying the brake system can be located inside or outside of the intake and exhaust valve cover of the engine.

20. An engine brake system for all types of diesel and gasoline engines, comprising a control means arranged on the cylinder head of the engine, in engagement with the tappet rods to disconnect them from the rocker arms when activating said brake system, and a dislodgement valve installed in the intake manifold of the engine, which remains closed until the brake system is applied, and which is open when the engine brake is applied by a valve activating device; a second activating device longitudinally displaces the control means when the brake system is applied, uncoupling the exhaust valve rocker arms from the corresponding tappet rods, thereby preventing the exhaust valves from opening, maintaining the gases trapped in the cylinders so as to oppose resistance against the ascending movement of the pistons during their exhaust stroke.

21. An engine brake system for use in overhead camshaft engines, wherein the exhaust cam elements of the camshaft directly pushes downwards the upper part of the plunger in order to tramsmit the motion to the respective exhaust valve; said system comprising a plurality of wedge mechanisms connected to the control means and being introduced partially in the plunger of each exhaust valve and acting further as an intermediate member for the transmission of the movement from the overhead camshaft to each exhaust valve; the inner portion of each wedge mechanism is arranged in alignment between a projection located on the internal upper surface of the plungers and an upwardly protruding bolt in the exhaust valves; upon activating the brake system, the wedge mechanisms are displaced in the same direction as and simultaneously with the control means, but without exiting completely from the plunger, thereby leaving a spacing between the projection of said plungers and the bolt of the exhaust valves, thereby ceasing the transmission of the movement form the camshaft to the exhaust valves, which are impeded to open until the system is deactivated.

22. The engine brake system described in claim 21 wherein the wedge mechanism is connected to the control means by an upright positioning bolt which is connected to an arm portion protruding perpendicularly to and from the control means.

23. The engine brake system described in claim 22, wherein each positioning bolt is surrounded by a spring means intended to keep the wedge mechanism in its respective functional position.

24. The engine brake system described in claim 21, wherein each exhaust plunger is exteriorly surrounded by a spring means that keeps it in permanent contact with the corresponding exhaust cam.

25. A joining mechanism for use in an engine brake system in order to increase the braking capacity of said engine by joining operatively the rocker arms of the intake valves; the joining mechanism being located over the line of rocker arms, comprising an elongate member which connects by pairs the rocker arms of the intake valves of two pistons of the engine; a tubular member containing said elongate member and being adapted to interconnect another pair of rocker arms of the intake valves of the remaining pistons in a four-cylinder engine; and a plurality of spring means to press the ends of the tubular member to apply by pairs the joined rocker arms since they cannot be applied simultaneously when the brake system is activated.

26. The joining mechanism described in claim 25, wherein a second tubular member and additional spring means are to be incorporated to interconnect a third pair of rocker arms of intake valves in a six-cylinder engine.

27. The joining mechanism described in claim 26, including further stop means for acting as supports of the extremities of the spring means opposite to those extremities which push the ends of the tubular members.

28. The joining mechanism described in claim 25, further comprising rocker arm elements mounted along the length of said mechanism, whereby the pistons of the engine are interconnected by means of the rocker arms of the intake valves; said rocker arm elements of the mechanism including opposite end adjustment pins.

29. The joining mechanism described in claim 25 for in-line engines with independent heads, wherein a metallic joint is adapted to encompass each one of the independent heads and to cover the hollow intermediate portions of said engine.

30. An engine brake system for all types of gasoline and diesel engines including a camshaft to activate the intake and exhaust valves of the engine through tappet rods; the brake system comprises a plurality of exhaust valve tappet rods, each including an upper rod portion and a lower rod portion in alignment and in permanent contact with each other during the operation of the engine without the brake system applied; one of the rod portions being capable of turning partially on its own axis besides the alternative upright movement received from the camshaft; and a movable control means arranged over the cylinder head of the engine in engagement with the exhaust valve tappet rods adapted to neutralize the transmission of the motion from the camshaft to the exhaust valves when the brake system is applied; a spring means is disposed between the upper and lower rod portions in order to keep them sufficiently spaced in such a way that the turnable rod portion is not obstructed during its rotation movement as a result of the application of the system brake; and a third rod portion being seated on the upper rod portion adapted to contact the corresponding exhaust rocker arm.

31. The engine brake system described in claim 30, wherein the upper rod portion is the portion capable of rotating when the control means is displaced upon applying the brake system; the lower rod portion is adapted to move alternatively but not in a rotary manner.

32. The engine brake system described in claim 30, wherein the contact ends of the upper and lower rod portions are provided with protuberances that are in permanent contact with each other except when one of the rod portions rotates when the brake system is activated.

33. The engine brake system described in claim 30, wherein the rotary rod portion has a rotation range of about 75° to 105° with respect to its own axis.

34. The engine brake system described in claim 30, wherein the engagement between the control means and each exhaust valve tappet rod occurs by means of the meshing of gear teeth provided on the control means and a gear element that surrounds the tappet rod.

35. The engine brake system described in claim 34, wherein the control means comprises a chain element that is coupled with the gear element that surrounds the tappet rod.

36. The engine brake system described in claim 30, wherein the lower rod portion rotates on its axis approximately 75° to 105° in order to neutralize the movement of the camshaft toward the exhaust valves while the upper rod portion is secured so as not to rotate, but it can move alternatively.

37. An engine brake system for all types of diesel and gasoline engines, wherein an assembly of intake an exhaust valve tappet rods connected, on the one hand, with respective intake and exhaust valves and, on the other hand, with intake and exhaust cams of the camshaft of the engine by the corresponding plungers; wherein the brake system is applied by longitudinally displacing the camshaft in such a way that the exhaust cams are dephased from the corresponding tappet rods of the exhaust valves, so that said exhaust valves remain in the closed position while the intake valves continue functioning normally due to the predetermined widening of the conventional intake cams, thereby allowing that intake cams and the intake valve tappet rods to remain in contact in spite of the displacement of the camshaft.

38. The engine brake system described in claim 37, wherein the exhaust cams of the camshaft are narrowed in such a way that when said camshaft is displaced, the exhaust cams are desaligned from the exhaust valve tappet rods and the intake cams and tappet rods are still aligned and allow normal operation of the intake valves.

39. The engine brake system described in claim 37, wherein the dephasing of the exhaust cams of the camshaft in relation to the tappet rods of the exhaust valves is achieved by moving the exhaust cams either closer to, or farther from the intake cams, thereby leading to the deactivation of the exhaust valves with a minimum displacement of the camshaft.

40. The engine brake system described in claim 37, including an additional cam element adjacent each conventional intake cam, keeping a mutual angular difference of about 180°, in such a way that upon moving longitudinally the camshaft the intake valves are activated each descending stroke of the piston, whereby the braking power of the system is increased.

41. The engine brake system described in claim 40, wherein the additional cam element comprises a double cam element that allows the intake valves to be actuated every 360° of the crankshaft rotation.

42. An engine brake system for use in overhead camshaft engines, wherein the exhaust cam elements of the camshaft directly pushes downwards the upper part of the plunger in order to transmit the motion to the respective exhaust valve; said system comprising a plurality of foil elements connected to the control means and acting as an intermediate member for the transmission of the movement from the overhead camshaft to each exhaust valve, each foil element having a bolt making contact with a protruding bolt of one of said exhaust valves when said brake system is not applied; upon activating the brake system, the foil elements are displaced in the same direction as and simultaneously with the control means for displacing said protruding bolt from contact with the bolt of the exhaust valves, thereby ceasing the transmission of the movement from the camshaft to the exhaust valves, which are impeded to open until the system is deactivated.

43. The engine brake system described in claim 42 wherein the foil element is connected to the control means by an upright positioning bolt which is connected to an arm portion protruding perpendicularly to and from the control means.

44. The engine brake system described in claim 43, wherein each positioning bolt is surrounded by a spring means intended to keep the foil element in its respective functional position.

45. The engine brake system described in claim 42, wherein the foil element has a perforation adjacent its bolt, where the bolt of the exhaust valve is lodged, when the foil element is displaced together with the control means upon application of the brake system.

46. The engine brake system described in claim 42, including a spring means inside the plunger to keep the foil element in permanent contact with the inner upper surface of said plunger in order to avoid noise production by the foil element during the operation of the engine.

* * * * *